US007905741B1

(12) United States Patent
Wade et al.

(10) Patent No.: US 7,905,741 B1
(45) Date of Patent: Mar. 15, 2011

(54) ANTI-VIBRATION CONNECTOR COUPLING WITH AN AXIALLY MOVABLE RATCHET RING

(75) Inventors: Ryan C. Wade, Endicott, NY (US); Brendon A. Baldwin, Guilford, NY (US); David Otis Gallusser, Oneonta, NY (US)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 12/796,252

(22) Filed: Jun. 8, 2010

Related U.S. Application Data

(63) Continuation-in-part of application No. 12/614,154, filed on Nov. 6, 2009.

(51) Int. Cl.
*H01R 4/38* (2006.01)

(52) U.S. Cl. ..... 439/321

(58) Field of Classification Search ..... 439/321, 439/318, 459, 471
See application file for complete search history.

(56) References Cited

U.S. PATENT DOCUMENTS

| | | | | |
|---|---|---|---|---|
| 2,728,895 | A | | 12/1955 | Quackenbush et al. |
| 3,601,764 | A | | 8/1971 | Cameron |
| 3,917,373 | A | | 11/1975 | Peterson |
| 4,208,082 | A | | 6/1980 | Davies et al. |
| 4,268,103 | A | | 5/1981 | Schildkraut et al. |
| 4,291,933 | A | | 9/1981 | Kakaris |
| 4,359,254 | A | | 11/1982 | Gallusser et al. |
| 4,472,013 | A | | 9/1984 | Frear |
| 4,506,942 | A | | 3/1985 | Flederbach et al. |
| 4,588,245 | A | | 5/1986 | Schwartz et al. |
| 4,629,272 | A | * | 12/1986 | Mattingly et al. ..... 439/318 |
| 4,971,501 | A | | 11/1990 | Chavez |
| 5,074,703 | A | | 12/1991 | Dawson |
| 5,188,398 | A | | 2/1993 | Parimore, Jr. et al. |
| 5,199,894 | A | | 4/1993 | Kalny et al. |
| 5,399,096 | A | * | 3/1995 | Quillet et al. ..... 439/321 |
| 5,435,760 | A | | 7/1995 | Miklos |
| 5,447,447 | A | | 9/1995 | Guss, III et al. |
| 5,458,501 | A | | 10/1995 | Lazaro, Jr. et al. |
| 5,580,278 | A | * | 12/1996 | Fowler et al. ..... 439/607.23 |
| 5,653,605 | A | * | 8/1997 | Woehl et al. ..... 439/321 |

(Continued)

FOREIGN PATENT DOCUMENTS

EP 0 247 814 12/1987

(Continued)

*Primary Examiner* — Chandrika Prasad
(74) *Attorney, Agent, or Firm* — Blank Rome LLP

(57) ABSTRACT

A connector coupling that comprises a connector body, a first collar coupled to the connector body, and a second collar surrounding the first collar. The first collar has a plurality of locking members. The second collar is rotatable with respect to the first collar between first and second positions. A ratchet ring is supported by the connector body and has a plurality of locking members corresponding to the plurality of locking members of the first collar. The ratchet ring being axially movable with respect to the connector body between an engaged position and a disengaged position. A biasing member is supported by the connector body adjacent the ratchet ring. The biasing member biases the ratchet ring in the engaged position. Rotating the second collar from the first position to the second position moves the ratchet ring from the engaged position, in which the plurality of locking members of the ratchet ring engage the plurality of the locking members of the first collar, to the disengaged position, in which the plurality of locking members of the ratchet ring are spaced from the plurality of locking members of the first collar, thereby allowing the first collar to rotate with respect to the connector body.

22 Claims, 14 Drawing Sheets

U.S. PATENT DOCUMENTS

| | | | | |
|---|---|---|---|---|
| 5,674,087 | A | 10/1997 | Kirma | |
| 5,957,716 | A | 9/1999 | Buckley et al. | |
| 5,971,787 | A | 10/1999 | Brown | |
| 6,086,400 | A * | 7/2000 | Fowler | 439/321 |
| 6,123,563 | A * | 9/2000 | Johnson et al. | 439/321 |
| 6,293,595 | B1 | 9/2001 | Marc et al. | |
| 6,602,085 | B2 * | 8/2003 | Young et al. | 439/321 |
| 7,032,931 | B2 | 4/2006 | Austin | |
| 7,544,085 | B2 * | 6/2009 | Baldwin et al. | 439/471 |
| 7,837,495 | B2 * | 11/2010 | Baldwin et al. | 439/459 |

FOREIGN PATENT DOCUMENTS

| | | |
|---|---|---|
| EP | 0 311 338 | 4/1989 |
| EP | 0 535 867 | 4/1993 |

* cited by examiner

ANTI-VIBRATION CONNECTOR COUPLING WITH AN AXIALLY MOVABLE RATCHET RING

RELATED APPLICATION

This application is a continuation-in-part under 35 U.S.C. §120 of currently pending application Ser. No. 12/614,154, entitled Anti-Vibration Connector Coupling, filed on Nov. 6, 2009.

FIELD OF THE INVENTION

The present invention relates to anti-vibration coupling for an electrical connector. More specifically, the coupling prevents counter-rotation of the electrical connector when engaged with its mating connector and subject to vibration or shock.

BACKGROUND OF THE INVENTION

Electrical connector assemblies generally include mating plug and receptacle connectors. Often a threaded nut or collar is used to mate the plug and receptacle connectors. When an electrical connector assembly is subject to vibration or shock, however, the mating connectors of the assembly, often become loose or even decouple. The loosening or decoupling usually occurs because the coupling nut counter rotates, that is it rotates in a direction opposite the mating or locking direction, thereby compromising the integrity of both the mechanical and electrical connection between the plug and receptacle connectors.

Examples of some prior art couplings for electrical connector assemblies include U.S. Pat. No. 6,293,595 to Marc et al; U.S. Pat. No. 6,123,563; U.S. Pat. No. 6,086,400 to Fowler; U.S. Pat. No. 5,957,716 to Buckley et al.; U.S. Pat. No. 5,435,760 to Miklos; U.S. Pat. No. 5,399,096 to Quillet et al.; U.S. Pat. No. 4,208,082 to Davies et al.; U.S. Pat. No. 3,917,373 to Peterson; and U.S. Pat. No. 2,728,895 to Quackenbush, the subject matter of each of which is hereby incorporated by reference.

SUMMARY OF THE INVENTION

Accordingly, the present invention relates to a connector coupling that comprises a connector body, a first collar coupled to the connector body, and a second collar surrounding the first collar. The first collar has a plurality of locking members. The second collar is rotatable with respect to the first collar between first and second positions. A ratchet ring is supported by the connector body and has a plurality of locking members corresponding to the plurality of locking members of the first collar. The ratchet ring is axially movable with respect to the connector body between an engaged position and a disengaged position. A biasing member is supported by the connector body adjacent the ratchet ring. The biasing member biases the ratchet ring in the engaged position. By rotating the second collar from the first position to the second position, the ratchet ring moves from the engaged position, in which the plurality of locking members of the ratchet ring engage the plurality of the locking members of the first collar, to the disengaged position, in which the plurality of locking members of the ratchet ring are spaced from the plurality of locking members of the first collar, thereby allowing the first collar to rotate with respect to the connector body.

The present invention also relates to a connector coupling that comprises a connector body, a first collar coupled to the connector body, and a second collar surrounding said first collar. The first collar has a plurality of locking members and a first engagement member. The second collar has a second engagement member that cooperates with the first engagement member of the first collar to allow the second collar to rotate with respect to the first collar between first and second positions. A ratchet ring is supported by the connector body. The ratchet ring has a plurality of locking members corresponding to the plurality of locking members of the first collar. The ratchet ring is axially movable with respect to the connector body between an engaged position and a disengaged position. A biasing member is supported by the connector body adjacent the ratchet ring. The biasing member biases the ratchet ring in the engaged position. By rotating the second collar from the first position to the second position, in which the second locking member is fully engaged with the first locking member, the ratchet ring moves from the engaged position, in which the plurality of locking members of the ratchet ring engage the plurality of the locking members of the first collar, to the disengaged position, in which the plurality of locking members of the ratchet ring are spaced from the plurality of locking members of the first collar, thereby allowing the first collar to rotate with respect to the connector body.

The present invention may also relate to a connector coupling that comprises a connector body, a first collar coupled to the connector body, a second collar surrounding the first collar, and an engagement means for engaging the first collar and the second collar so that the second collar rotates with respect to the first collar between first and second positions. A ratchet ring is supported by the connector body. The ratchet ring is axially movable with respect to the connector body between an engaged position and a disengaged position. A locking means may be provided for locking the first collar and the ratchet ring when the ratchet ring is in the engaged position. A biasing member is supported by the connector body adjacent the ratchet ring which biases the ratchet ring in the engaged position. By rotating the second collar from the first position to the second position, the ratchet ring moves from the engaged position, in which the ratchet and the first collar are locked by said locking means, to said disengaged position, in which said ratchet ring is spaced from the first collar, thereby allowing the first collar to rotate with respect to the connector body.

Other objects, advantages and salient features of the invention will become apparent from the following detailed description, which, taken in conjunction with the annexed drawings, discloses a preferred embodiment of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
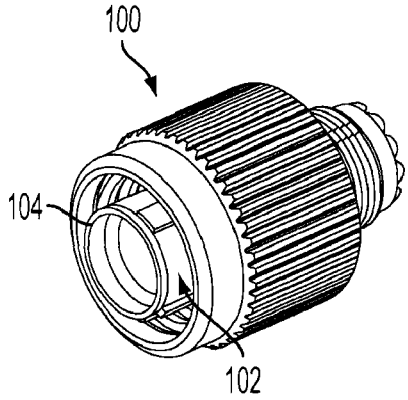
FIG. 1 is a perspective view of a coupling according to a first exemplary embodiment of the present invention, showing the coupling disposed on the body of a connector.
Figure 2:
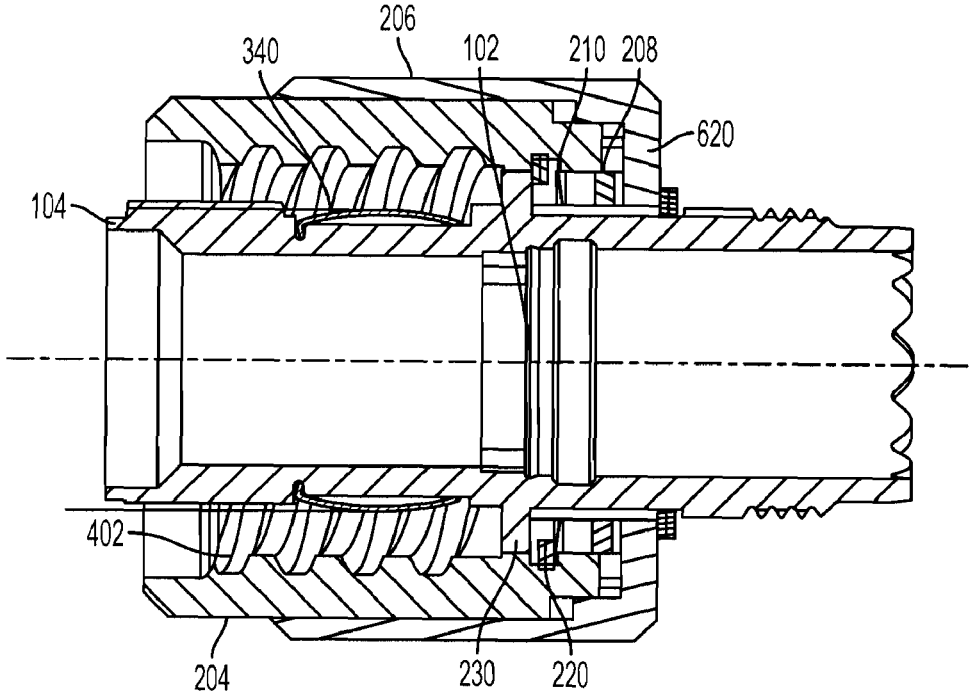
FIG. 2 is a cross-sectional view of the coupling and connector body illustrated in FIG. 1.

Referring to FIGS. 1-9, the present invention relates to an anti-vibration coupling 100 for an electrical connector assembly, such as a plug and receptacle. The coupling 100 preferably provides a one-way ratchet engagement such that the connectors of the assembly can only be disengaged manually by moving the coupling 100 between engaged (FIG. 8) and disengaged (FIG. 9) positions. The coupling 100 is preferably disposed on a connector body 102 and may include an inner collar 204, an outer collar 206, a ratchet ring 208, and a biasing member 210, as seen in FIG. 2.

FIGS. 1 and 2 illustrate the coupling 100 coupled to the connector body 102 of the connector assembly. The connector body 102 may be the shell of a plug connector, for example. In the preferred embodiment, the inner collar 204 accepts the connector body 102 and the outer collar 206 receives the inner collar 204. Both the ratchet ring 208 and the biasing member 210 are preferably disposed between the connector body 102 and the inner and outer collars 204 and 206.

Figure 4:
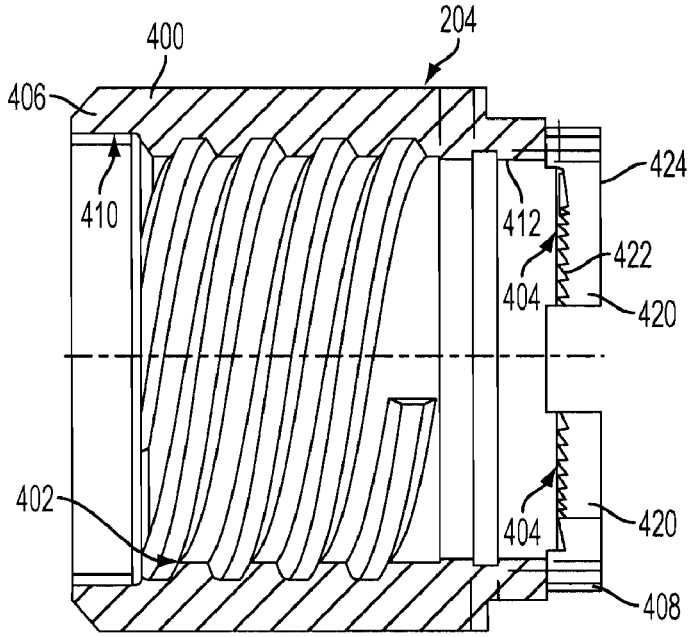
FIG. 4 is a cross-sectional view of an inner collar of the coupling illustrated in FIG. 1.
Figure 5:
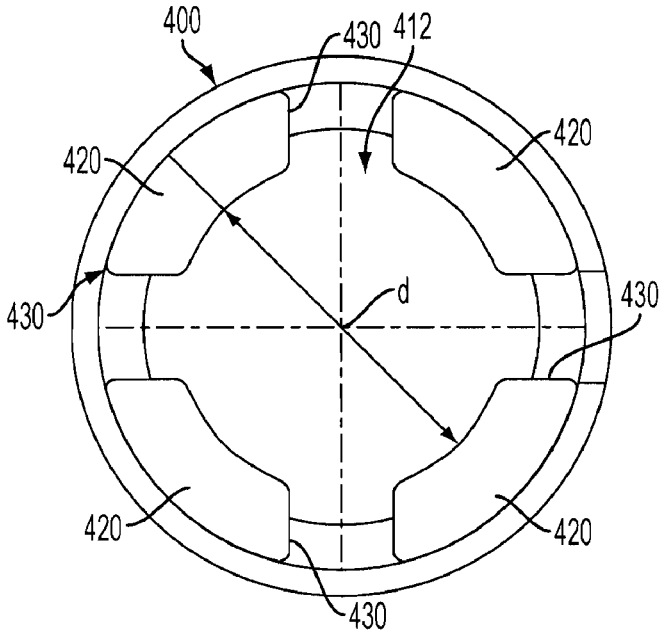
FIG. 5 is an end elevational view of the inner collar illustrated in FIG. 4.

As best seen in FIGS. 2, 4 and 5, the inner collar 204 may include a main body 400 with internal threads 402 for engaging the mating connector (not shown), such as a receptacle, and a first set of teeth 404 for engaging the ratchet ring 208. The main body 400 may include first and second opposite ends 406 and 408 that define first and second openings 410 and 412, respectively, through which the connector body 402 extends.

Extending from the second end 408 of the main body 400 is a first set of a plurality of projections 420. The projections 420 define the diameter d of the second opening 412 of the collar's main body 400 such that the second opening 412 is smaller than the first opening 410. Each projection 420 includes opposite inner and outer surfaces 422 and 424 where the inner surfaces 422 faces the internal threads 402 of the main body 400 and the outer surfaces 424 faces outside of the main body 400. Between each of the projections 420 are slots 430, as best seen in FIG. 5.

Figure 9:
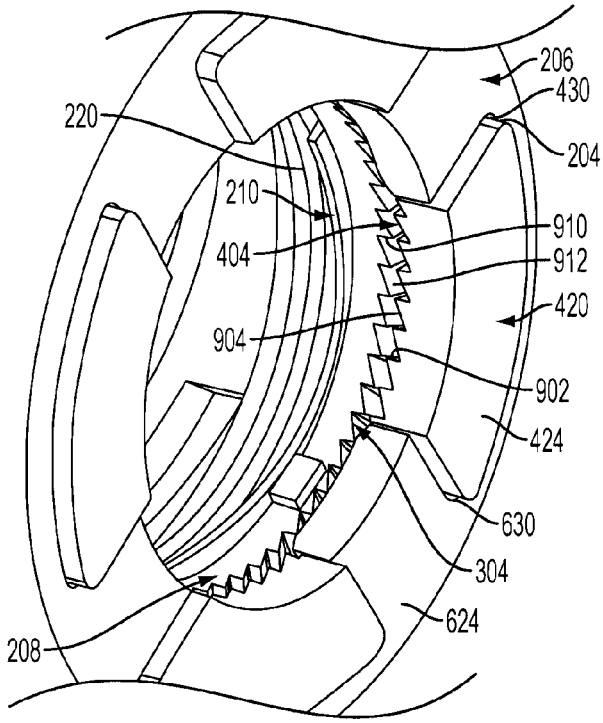
FIG. 9 is a partial end perspective view of the coupling similar to FIG. 8, showing the coupling in a disengaged position.

As seen in FIGS. 4 and 9, the first set of teeth 404 extend from the inner surfaces 422 of each projection 420. Each tooth of the first set of teeth 404 may include a flat surface 902 that is preferably substantially perpendicular to the inner surface 422 of each respective projection 420, and an angled surface 904 that is angled with respect to the flat surface 902.

Figure 3:
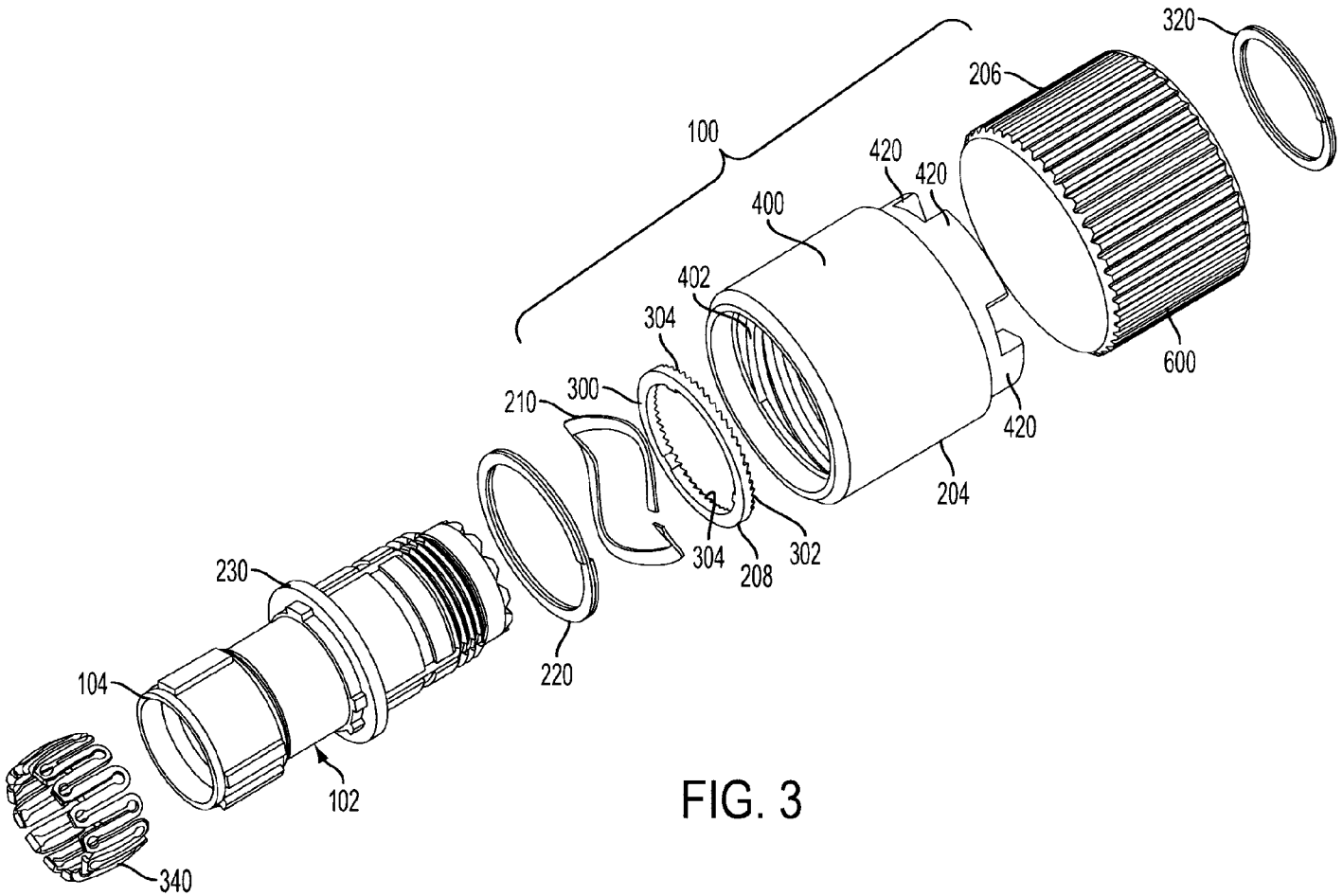
FIG. 3 is an exploded perspective view of the coupling and the connector body illustrated in FIG. 1.

The inner collar 204 is coupled to the connector body 102 such that it is rotatable with respect to the connector body 102; however its axial movement relative to the connector body 102 is restrained by a retaining clip 220 (FIGS. 2 and 3). More specifically, the retaining clip 220 surrounds the connector body 102 and resides in an inner annular groove of the inner collar 204. An outer flange 230 of the connector body 102 creates a stop to prevent the retaining clip 220 and the inner collar 204 from moving axially forward with respect to the connector body 102. Retaining ring 320 restrain axial movement of the inner collar 204 in the opposite or back direction.

Figure 6:
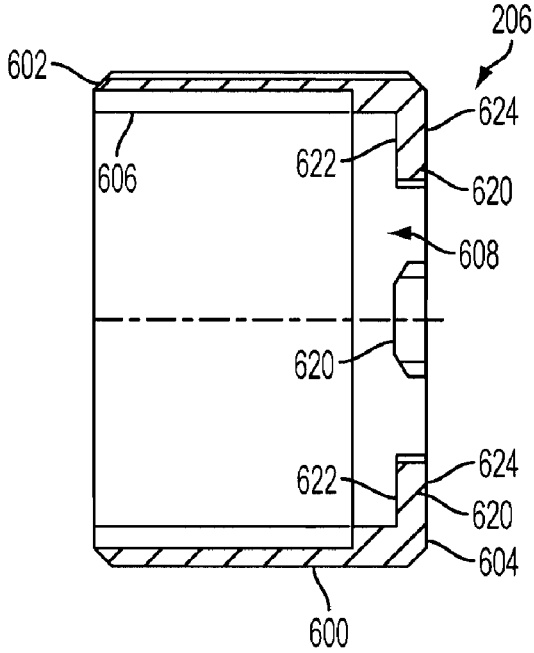
FIG. 6 is a cross-sectional view of an outer collar of the coupling illustrated in FIG. 1.
Figure 7:
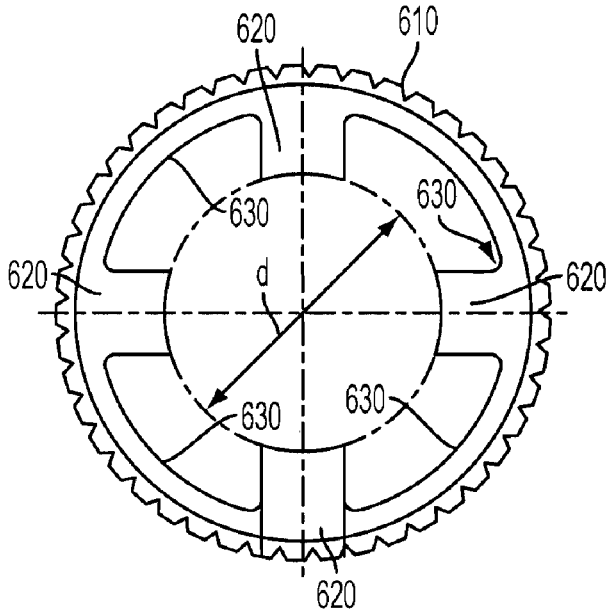
FIG. 7 is an end elevational view of the outer collar illustrated in FIG. 6.

The outer collar 206 surrounds the inner collar 204 to provide a mechanism for manually unlocking the inner collar 204. The outer collar 206 is designed to slide axially with respect to the inner collar 204 and the connector body 102. As seen in FIGS. 2, 6 and 7, the outer collar 206 generally includes a main body 600 opposite first and second ends 602 and 604 that define first and second openings 606 and 608, respectively. The first opening 606 is sized to receive the inner collar 204, and the second opening 608 is sized to receive only the connector body 102. The main body 600 may include an outer gripping surface 610 to facilitate rotational and axial movement of the outer collar 206.

Extending from the second end 604 of the main body 600 is a second set of projections 620 which define the diameter d of the second opening 608 of the main body 600. The second opening 608 of the outer collar 206 is substantially the same size as the second opening 412 of the inner collar 204. Slots 630 are defined between the projections, as best seen in FIG. 7. Each projection 620 of the second set of projections includes opposite inner and outer surfaces 622 and 624. Each projection 620 of the second set of projections is shaped to correspond to or match the slots 430 of the inner collar 204. Likewise, each projection 420 of the first set of projections is shaped to correspond to the slots 630 of the outer collar 206.

As seen in FIGS. 2 and 3, the ratchet ring 208 is positioned on the connector body 102 between its outer flange 230 and the outer collar 206. The ratchet ring 208 may include opposite first and second surfaces 300 and 302. The first surface 300 is generally flat and is adapted to engage the biasing member 210. The second surface 302 includes a second set of teeth 304 extending therefrom that are adapted to engage the first set of teeth 404 of the inner collar 204 in a one-way ratchet engagement. Similar to the teeth of the first set of teeth 404 of the inner collar 204, each tooth of the second set of teeth 304 of the ratchet ring 208 includes a first surface 910 that is generally flat such that it is substantially perpendicular to the first surface 300 of the ratchet ring 208, and a second surface 912 that is angled relative to the flat first surface 910.

When assembling the coupling 100 to the connector body 102, the connector body 102 extends through the first and second openings 410, 606 and 412, 608 of the inner and outer collars 204 and 206, respectively, with the outer collar 206 surrounding the inner collar 204. A retaining clip 320 may be provided on the connector body 102 outside of the outer collar 206, thereby retaining the inner collar 204, the outer collar 206, the ratchet ring 208 and the biasing member 210 on the connector body 102. The retaining clip 220 restricts the axially movement of the inner collar 204 relative to the connector body. A grounding band 340 may be provided between the connector body 102 and the inner collar 204.

Figure 8:
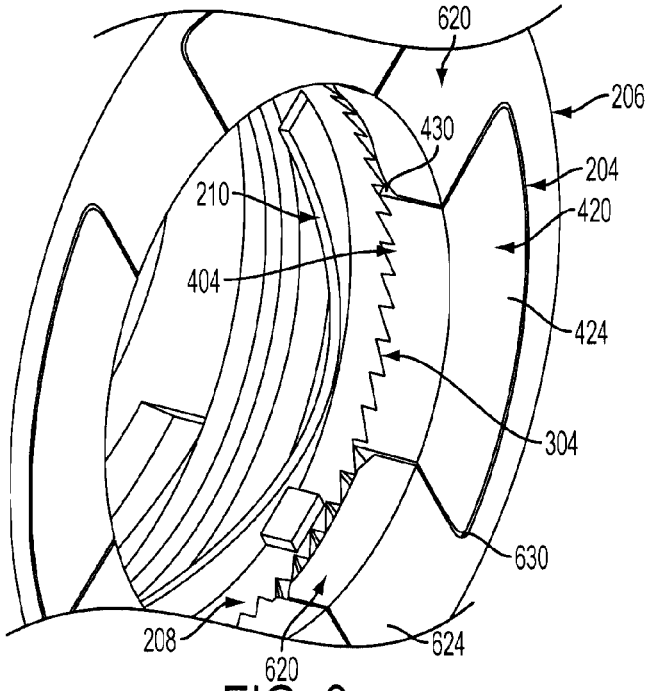
FIG. 8 is a partial end perspective view of the coupling illustrated in FIG. 1, showing the coupling in an engaged position.

The biasing member 210, which may be a wave spring, for example, biases the coupling 100 into the engaged position, as seen in FIG. 8. In the engaged position, the inner collar 204 can be rotated in only one direction to couple to the mating connector via its inner threads 402. The shaped of the teeth of the first and second sets of teeth 404 and 304 of the inner collar 204 and the ratchet ring 208, respectively, allow for rotation or ratcheting in one direction only, e.g. counter-clockwise when viewed from front end 104, and not in the opposite direction, i.e. a counter rotation. This arrangement generally prevents decoupling of the mating connectors due to vibration. More specifically, the angled surfaces 904 and 912 of the teeth of the first and second sets of teeth 404 and 304 allow the inner collar 204 to rotate or ratchet, for example clockwise with respect to the ratchet ring 208 and the connector body 102. Because the flat or substantially perpendicular surfaces 902 and 910 of the teeth of the first and second sets of teeth 404 and 304 abut one another, the inner collar 204 is prevented from rotating or ratcheting back in the opposite direction.

In the engaged position, illustrated in FIG. 8, the first set of teeth 404 of the inner collar 204 are engaged with the second set of teeth 304 of the ratchet ring 208. In addition, the projections 420 of the inner collar 204 are received in the slots 630 of the outer collar 206. Similarly, the projections 620 of the outer collar 206 are received in the slots 430 of the inner collar 204. The outer surfaces 424 and 624 of the inner collar projections 420 and the outer collar projections 620, respectively, are substantially flush. Also, the inner surfaces 622 of the projections 620 of the outer collar 208 abut some of the teeth 304 of the ratchet ring 208, as best seen in FIG. 8.

The coupling 100 may be manually unlocked to allow the inner collar 204 to rotate in the opposite direction, e.g. clockwise when viewed from front end 104 of the connector body 102. The manual unlocking allows decoupling the inner threads 402 of the inner collar 204 from the mating connector. To unlock the coupling 100, the outer collar 206 is moved axially relative to the inner collar 204 and the connector body 102 in the forward direction, i.e. towards the forward end 104 of the connector body 102. The outer collar 206 moves against the biasing of the biasing member 210 to separate the first and second sets of teeth 404 and 304.

FIG. 9 illustrates the coupling 100 in the disengaged position after the coupling 100 is manually unlocked. As the outer collar 206 is moved forward, the inner surfaces 622 of the projections 620 of the outer collar 206 push against the teeth of the ratchet ring 208 and against the bias of the biasing member 210 to separate the teeth 304 from the teeth 404 of the inner collar. As seen in FIG. 9, the outer surfaces 624 and 424 of the outer collar's projections 620 and the inner collar's projections 420, respectively, are no longer flush and are instead offset from one another by a distance equal to the distance the outer collar 206 is axially moved forward. Because the teeth 304 of the ratchet ring 208 and the teeth 404 of the inner collar 204 are now spaced from one another, the inner collar 204 may freely rotate in either direction relative to the connector body 102.

Referring to FIGS. 10-16B, a connector coupling 1000 according to a second exemplary embodiment is similar to the coupling 100 of the first embodiment in that it provides a one-way ratchet that can only be disengaged manually. Like the coupling 100, the coupling 1000 of the second embodiment includes an inner collar 1004 that receives the connector body 1002, an outer collar 1006 that surrounds the inner collar 1004, and a ratchet ring 1008 that is disposed on the body and is spring biased by a biasing member 1010. The manual release of the connector coupling 1000 of the second embodiment differs from the coupling 100 of the first embodiment in that it adds an engagement mechanism between the coupling's collars 1004 and 1006.

Figure 10:
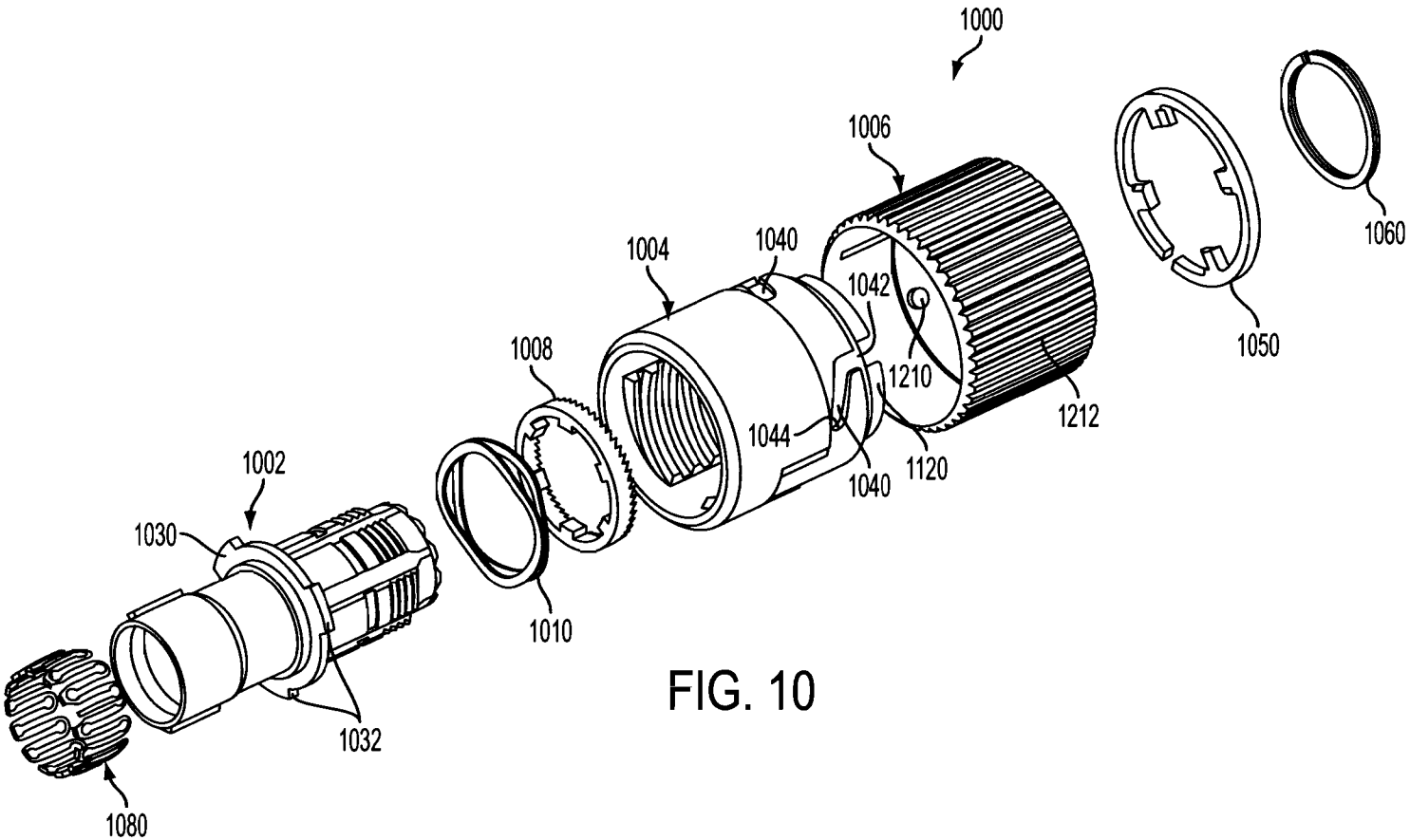
FIG. 10 is an exploded perspective view of a coupling in accordance with a second exemplary embodiment of the invention.
Figure 11C:
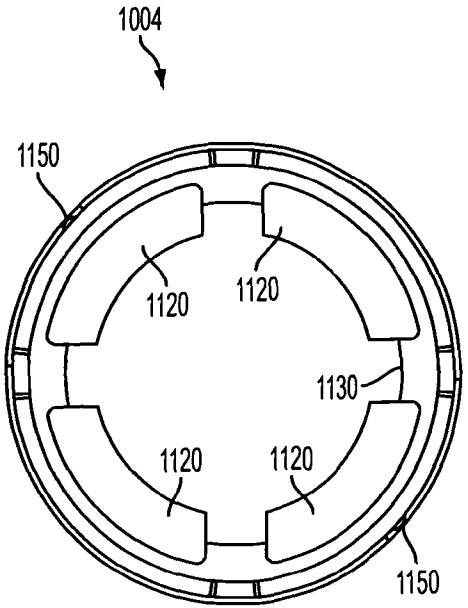
FIG. 11C is an end elevational view of the inner collar, showing the inner collar from the opposite end of FIG. 11A.
Figure 11B:
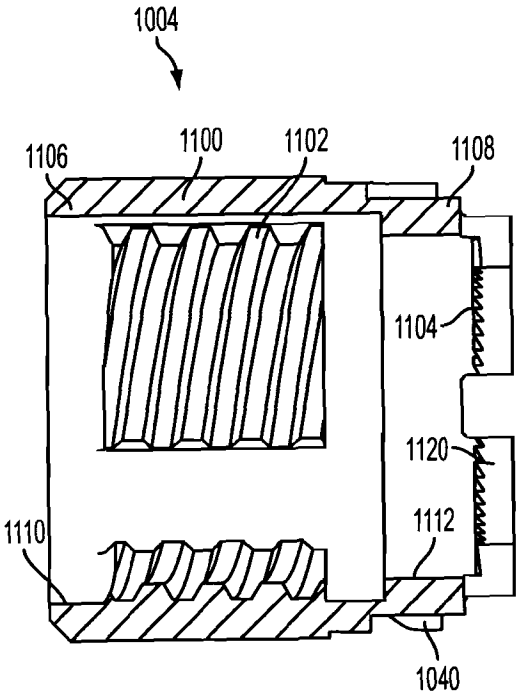
FIG. 11B is a cross sectional view of the inner collar taken along line 11B-11B of FIG. 11A.
Figure 11A:
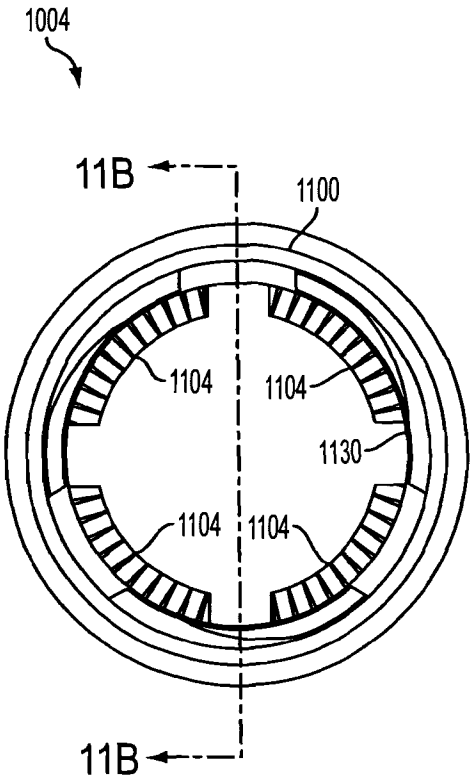
FIG. 11A is an end elevational view of an inner collar of the coupling illustrated in FIG. 10.
Figure 15A:
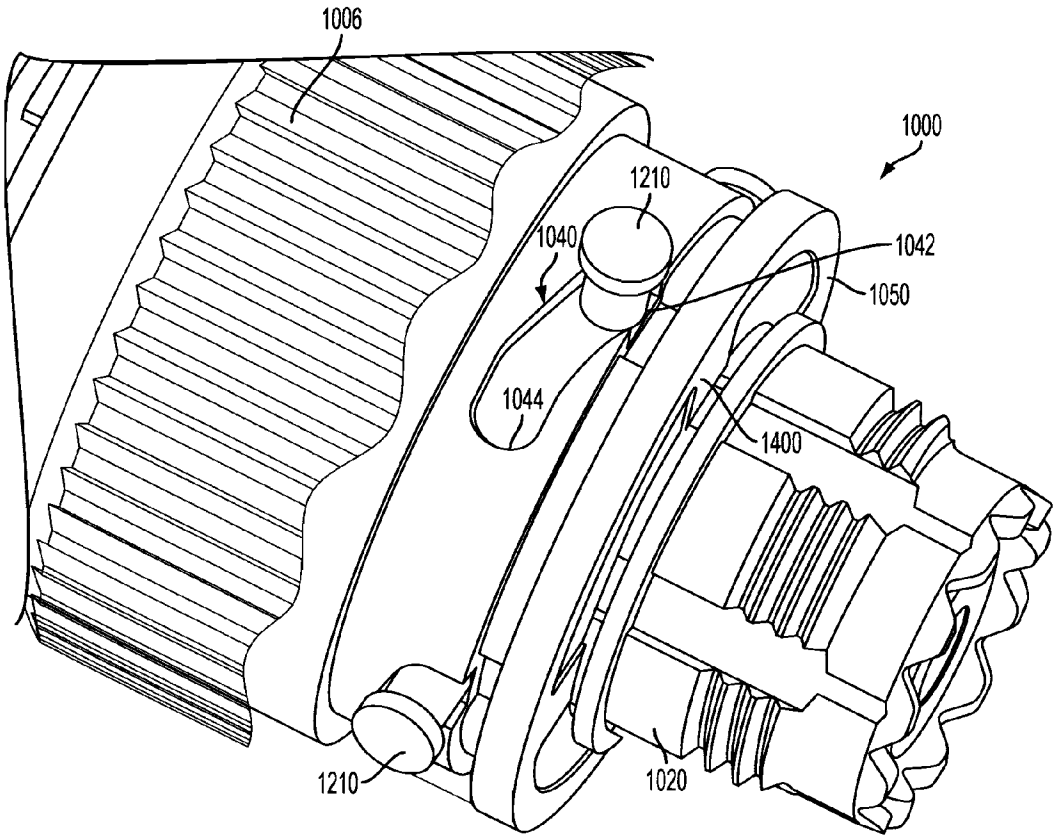
FIG. 15A is a perspective view of the coupling illustrated in FIG. 10, showing the outer collar of the coupling in a first position with a portion of the outer collar cut away.
Figure 16A:
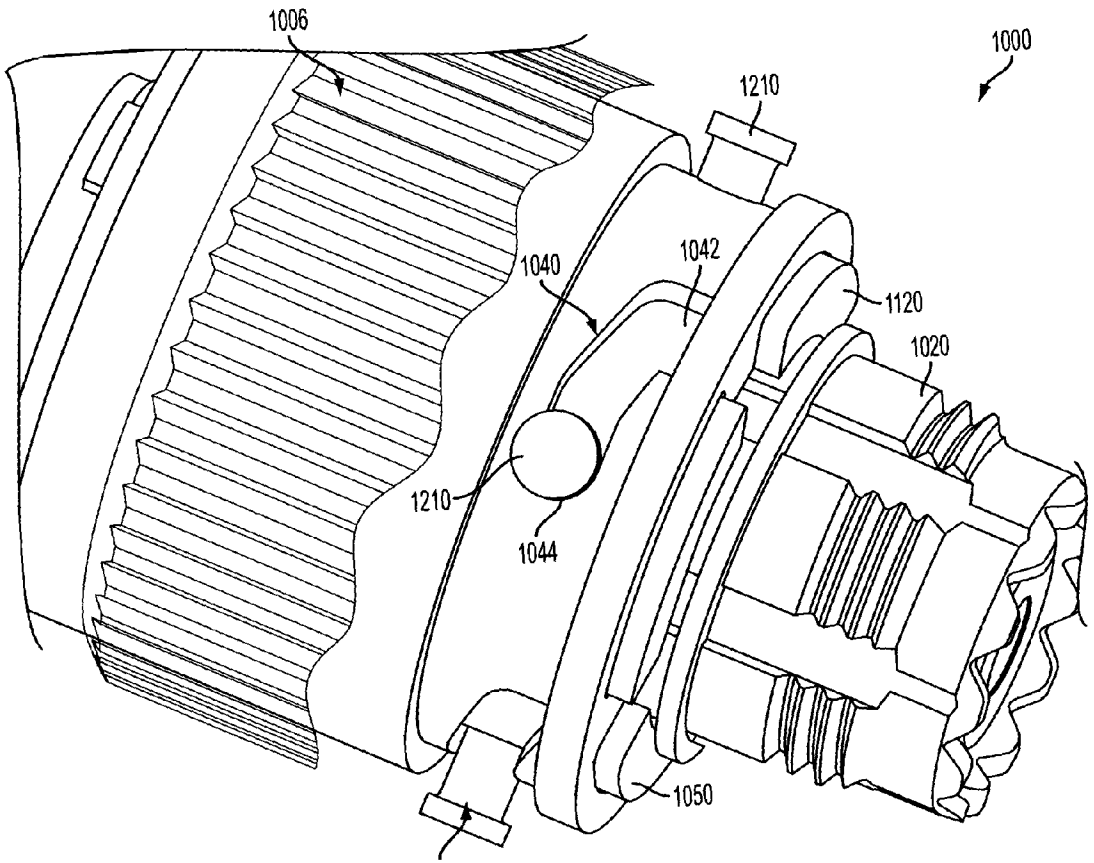
FIG. 16A is a perspective view of the coupling illustrated in FIG. 10, showing the outer collar of the coupling in a second position with a portion of the outer collar cut away.

As seen in FIGS. 11A-11C, the inner collar 1004 may include a main body 1100 with internal threads 1102 for engaging the mating connector, and a plurality of locking members 1104, which may be teeth, for engaging the ratchet ring 1008. The main body 1100 may include first and second opposite ends 1106 and 1108 that define first and second openings 1110 and 1112, respectively, through which the connector body 1002 extends. The second end 1108 is adapted to engage the outer collar 1006 via an engagement mechanism that allows the outer collar 1006 to rotate with respect to the inner collar 1004 between a first position, as seen in FIG. 15A, and a second position, as seen in FIG. 16A. Part of the engagement mechanism, may be, for example, one or more bayonet channels 1040 disposed on the outer surface of the inner collar 1004 at its second end 1108. Each bayonet channel 1040 includes an open end 1042 and an opposite closed end 1044, as seen in FIG. 10.

The locking members 1104 preferably extend from spaced apart projections 1120 extending inwardly from the second end 1108 of the inner collar 1004, as seen in FIGS. 11A and 11B. The locking members 1104 extend axially with respect to the main body 1100 of the collar and toward the interior of the body 1100. Between each of the projections 1120 are slots 1130, as best seen in FIG. 11C.

The inner collar 1004 rotates relative to the connector body 1002. An outer flange 1030 of the connector body 1002 creates a stop to prevent the inner collar 1004 from moving axially forward with respect to the connector body 1002. Interference bumps 1150 may be provided on the exterior of the inner collar 1004 that engage the outer collar 1006.

Figure 12B:
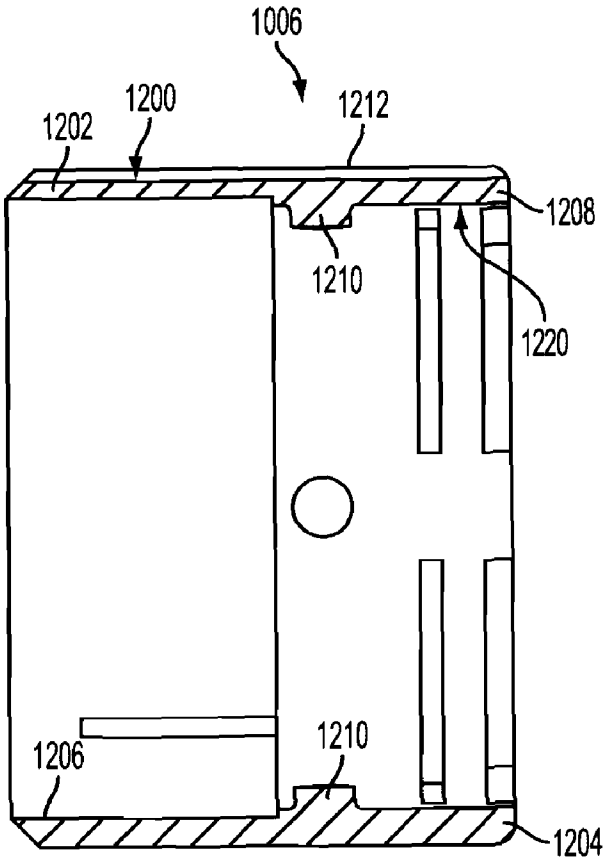
FIG. 12B is a cross sectional view of the outer collar taken along line 12B-12B of FIG. 12A.
Figure 12A:
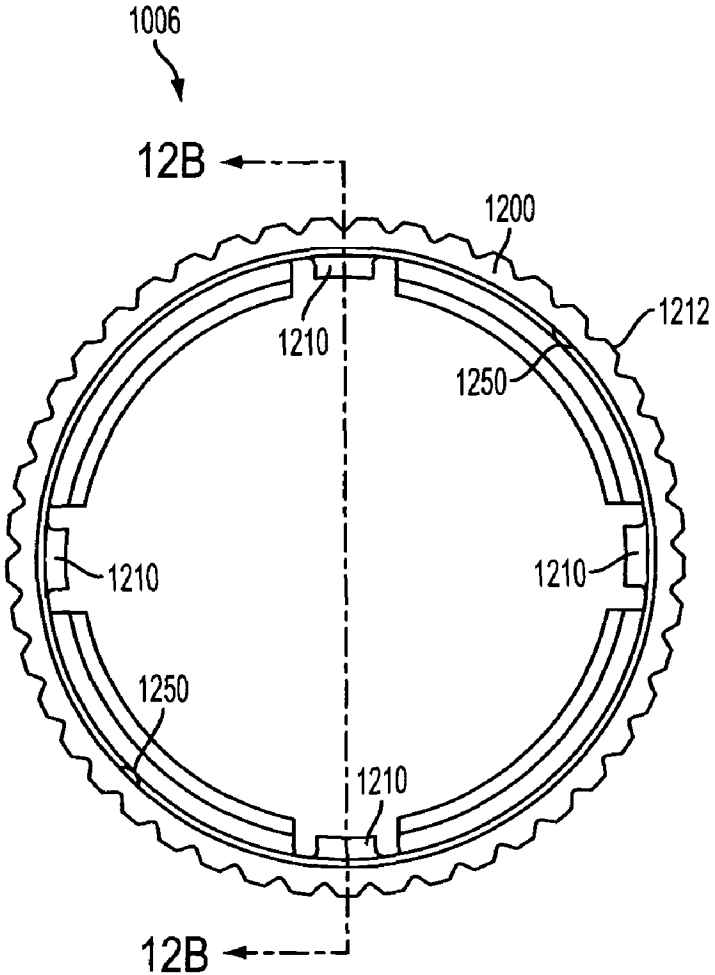
FIG. 12A is an end elevational view of an outer collar of the coupling illustrated in FIG. 10.

Like the first embodiment, the outer collar 1006 provides a mechanism for manually unlocking the inner collar 1004 from the ratchet ring 1008. The outer collar 1006 receives the inner collar 1004 and is designed to rotate with respect to the inner collar 1004 and the connector body 1002. As seen in FIGS. 12A and 12B, the outer collar 1006 generally includes a main body 1200 that has opposite first and second ends 1202 and 1204 that define first and second openings 1206 and 1208, respectively. The main body 1200 may include an outer gripping surface 1212 to facilitate rotational movement of the outer collar 1006. Extending radially from the inner surface of the outer collar 1006 are one or more bayonets pins 1210 which are adapted to cooperate with the bayonet channels 1040 of the inner collar 1004. That pins 1210 are preferably integral with the collar 1006, as seen in FIG. 12B. However, the pins 1210 may be separately formed and attached to the collar 1006. Adjacent the pins 1210 is an inner radial groove 1220 that receives an actuating ring 1050. Interference bumps 1250 may be provided on the inner surface of the outer collar which correspond to bumps 1150 on the inner collar 1004.

Figure 13B:
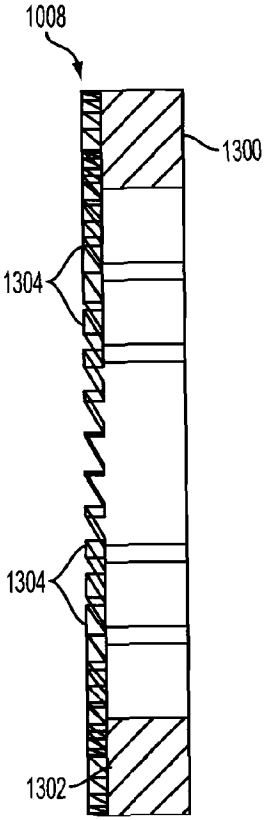
FIG. 13B is a cross sectional view of the ratchet ring taken along line 13B-13B of FIG. 13A.
Figure 13A:
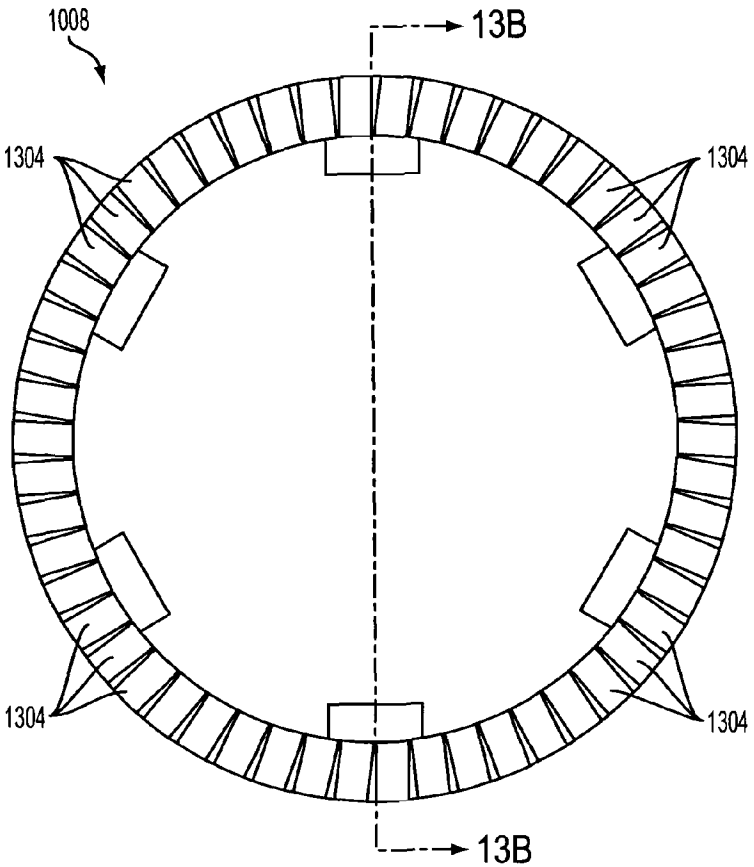
FIG. 13A is an end elevational view of a ratchet ring of the coupling illustrated in FIG. 10.
Figure 15B:
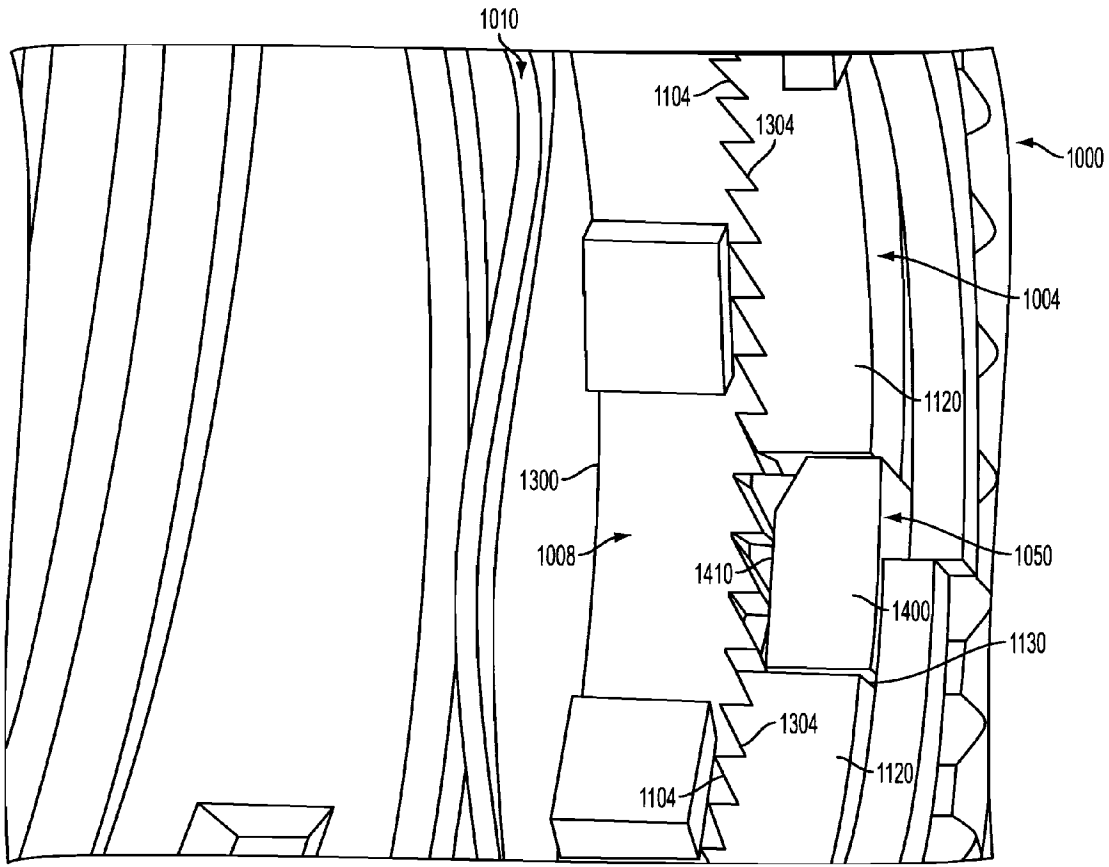
FIG. 15B is an enlarged partial perspective view of the coupling illustrated in FIG. 15A, showing the outer collar in the first position and the ratchet ring in the engaged position.

The ratchet ring 1008 is positioned on the connector body 1002 between its outer flange 1030 and the outer collar 1006. As seen in FIGS. 10, 13A and 13B, the ratchet ring 1008 may include opposite first and second surfaces 1300 and 1302. The first surface 1300 is generally flat and is adapted to abut the biasing member 1010. The second surface 1302 includes a plurality of locking members 1304, such as teeth, extending therefrom that are adapted to engage the locking members 1104 of the inner collar 1004, as seen in FIG. 15B. Like the teeth of the first embodiment, the locking members 1104 of the inner collar 1004 and the locking members 1304 of the ratchet ring 1008 have cooperating angled and flat surfaces to create a one-way ratchet engagement.

Figure 14B:
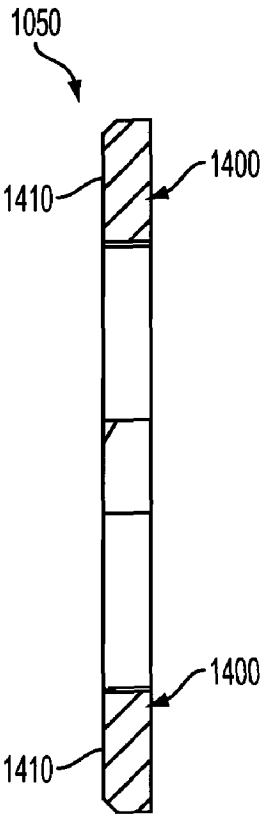
FIG. 14B is a cross sectional view of the actuating ring taken along line 14B-14B of FIG. 14A.
Figure 14A:
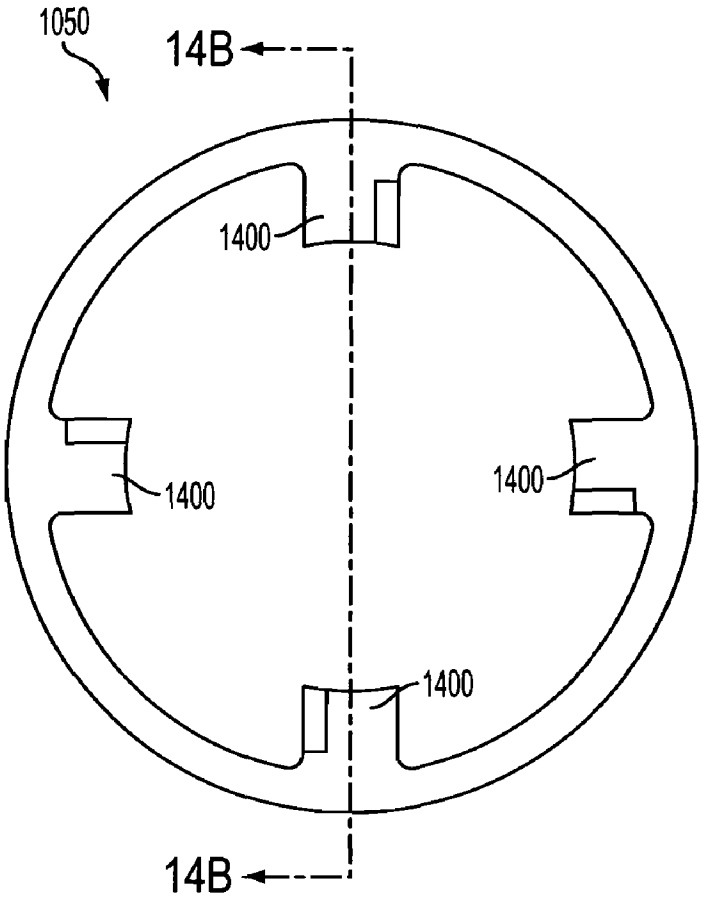
FIG. 14A is an end elevational view of an actuating ring of the coupling illustrated in FIG. 10.

The actuating ring 1050 (FIG. 10) is designed to be received in the radial inner groove 1220 of the outer collar 1006 and is adapted to surround the projections 1120 at the second end 1108 of the inner collar 1004, as seen in FIG. 15B. The actuating ring 1050 may include one or more inner radial projections 1400, as seen in FIGS. 14A and 14B. The projections 1400 are spaced and sized to be received in the slots 1130 between the projections 1120 of the inner collar, as seen in FIG. 15B. Each projection 1400 includes a surface 1410 that is adapted to abut the locking members 1304 of the ratchet ring 1008.

The coupling 1000 is assembled in a similar manner to that of the coupling 100 of the first embodiment. The outer collar 1006 receives the actuating ring 1050 in its inner groove 1220 and receives the inner collar 1004 such that the actuating ring 1050 surrounds the portion of the second end 1108 of the inner collar 1004 that includes the projections 1120 and the outer collar 1006 surrounds both the inner collar 1004 and the actuating ring 1050. The connector body 1002 extends through the first and second openings of the inner and outer collars 1004 and 1006. A retaining clip 1060 may be provided on the connector body 1002 outside of the outer collar 1006 to retain the inner collar 1004, the outer collar 1006, the ratchet ring 1008 and the biasing member 1010 on the connector body 1002. A grounding band 1080 may be provided between the connector body 1002 and the inner collar 1004.

Referring to FIGS. 15A-15B, the assembled coupling 1000 is shown in its engaged position wherein the inner collar 1004, which is threadably coupled to a mating connector (not shown) via its inner threads 1102, is prevented from rotating in the release direction, thereby avoiding decoupling of the two mating connectors. In this position, the locking members 1104 of the inner collar 1004 and the locking members 1304 of the ratchet ring 1008 are engaged, as seen in FIG. 15B, such that the inner collar 1004 may rotate in a locking direction via a ratcheting action but may not rotate in the opposite or release direction. The biasing member 1010 acts to push the ratchet ring 1008 towards the locking members 1104 of the inner collar 1004. The projections 1400 of the actuating ring 1050 rest in the slots 1130 between the projections 1120 of the inner collar 1004, as best seen in FIG. 15B. The abutment surfaces 1410 of each of the actuating ring projections 1400 may abut or be slightly spaced from the locking members 1304 of the ratchet ring 1008.

In this engaged position, the outer collar 1006 is oriented relative to the inner collar 1004 in its first position, as best in FIG. 15A. In the first position, the pins 1210 extending inwardly from the outer collar 1006 engage the corresponding channels 1040 disposed in the outer surface of the inner collar 1004. More specifically, the pins 1210 rest in the open ends 1042 of the channels 1040. Tabs 1032 may be provided extending from the body's flange 1030 which interface with a shoulder on the inside of the inner collar 1004. The tabs 1032 help to prevent the spring 1010 from being over compressed.

Figure 16B:
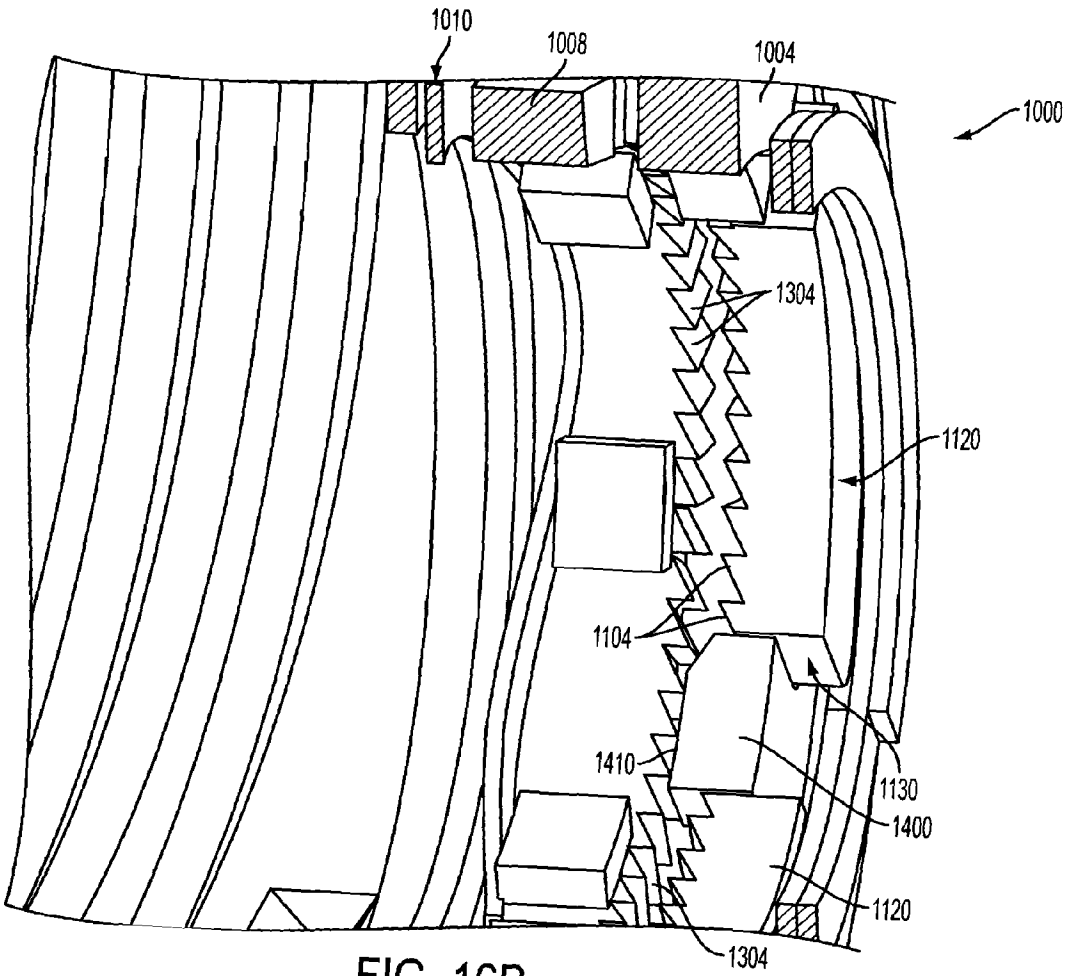
FIG. 16B is an enlarged partial perspective view of the coupling illustrated in FIG. 16A, showing the outer collar in the second position and the ratchet ring in the disengaged position.

Once in its engaged position, the coupling 1000 may only be released by manually unlocking the inner collar 1004 and the ratchet ring 1008 using the outer collar 1006. FIGS. 16A-16B illustrate the coupling in its released or disengaged position after actuating the outer collar 1006. More specifically, the outer collar 1006 is rotated in a tightening direction relative to the inner collar 1004 to its second position so that the pins 1210 of the outer collar 1006 move up the ramp of the channels 1040 of the inner collar 1004 until the pins 1210 are received in the closed ends 1044 of the channels 1040, as best seen in FIG. 16A. This action of rotating and tightening the outer collar 1006 axially advances the outer collar 1006 and the actuating ring 1050 received therein toward the ratchet ring 1008 against the bias of the biasing member 1010. In doing so, the projections 1400 of the actuating ring 1050 also move toward the ratchet ring 1008 such that the projection abutment surfaces 1410 push the locking members 1304 and the ratchet ring 1008 away from the locking members 1104 of the inner collar 1004, as best seen in FIG. 16B. With the locking members 1104 and 1304 spaced and disengaged from each other, the inner collar 1004 is allowed to rotate in the release direction to decouple the two mating connectors.

Although the preferred engagement mechanism between the inner and outer collars 1004 and 1006 for manually unlocking the coupling 1000 is cooperating bayonets pins 1210 and channels 1040, other known engagement mechanisms may be used, such as a threaded engagement. Also, the pins 1210 and the channels 1040 may be located on either one of the inner and outer collars 1004 and 1006.

While particular embodiments have been chosen to illustrate the invention, it will be understood by those skilled in the art that various changes and modifications can be made therein without departing from the scope of the invention as defined in the appended claims. For example, any number of projections 420 on the inner collar 204 and any number of projections 620 on the ratchet ring 208 may be employed. Also, the biasing member is not limited to a wave spring and may be any type of biasing mechanism, such as a compression spring.

What is claimed is:

1. A connector coupling, comprising of:

a connector body;

a first collar coupled to said connector body, said first collar having a plurality of locking members;

a second collar surrounding said first collar, said second collar being rotatable with respect to said first collar between first and second positions;

a ratchet ring supported by said connector body, said ratchet ring having a plurality of locking members corresponding to said plurality of locking members of said first collar, said ratchet ring being axially movable with respect to said connector body between an engaged position and a disengaged position; and a biasing member supported by said connector body adjacent said ratchet ring, said biasing member biasing said ratchet ring in said engaged position, wherein rotating said second collar from said first position to said second position moves said ratchet ring from said engaged position, in which said plurality of locking members of said ratchet ring engage said plurality of said locking members of said first collar, to said disengaged position, in which said plurality of locking members of said ratchet ring are spaced from said plurality of locking members of said first collar, thereby allowing said first collar to rotate with respect to said connector body.

2. A connector coupling according to claim 1, wherein said plurality of locking members of said first collar and said ratchet ring are interengaging teeth.

3. A connector coupling according to claim 1, wherein said plurality of locking members extend inwardly from said first collar so that said plurality of locking members are axially oriented with respect to said connector body.

4. A connector coupling according to claim 1, wherein said first collar has an end that engages said second collar; said end of said first collar including at least one channel for receiving a corresponding pin of said second collar.

5. A connector coupling according to claim 4, wherein said at least one channel includes opposite open and closed ends; and said pin of said second collar engages said open end when said second collar is in said first position, and said pin engages said closed end when said second collar is rotated to said second position.

6. A connector coupling according to claim 1, further comprising an actuating ring received in said second collar, said actuating ring including at least one inward extension for abutting said plurality of locking members of said ratchet ring when said ratchet ring is in said disengaged position.

7. A connector coupling according to claim 6, wherein said plurality of locking members of said first collar extend from spaced apart projections extending inwardly from said first collar; and said at least one inward extension of said actuating ring is received in at least one slot defined between said spaced apart projections of said first collar.

8. A connector coupling according to claim 1, wherein said biasing member is disposed between an annular flange of said connector body and said ratchet ring.

9. A connector coupling according to claim 8, wherein said biasing member is a wave spring.

10. A connector coupling according to claim 1, wherein said first collar is internally threaded for engaging a mating connector.

11. A connector coupling, comprising of:

a connector body;

a first collar coupled to said connector body, said first collar having a plurality of locking members and a first engagement member;

a second collar surrounding said first collar and having a second engagement member that cooperates with said first engagement member of said first collar to allow said second collar to rotate with respect to said first collar between first and second positions;

a ratchet ring supported by said connector body, said ratchet ring having a plurality of locking members corresponding to said plurality of locking members of said first collar, said ratchet ring being axially movable with respect to said connector body between an engaged position and a disengaged position; and a biasing member supported by said connector body adjacent said ratchet ring, said biasing member biasing said ratchet ring in said engaged position, wherein rotating said second collar from said first position to said second position, in which said second locking member is fully engaged with said first locking member, moves said ratchet ring from said engaged position, in which said plurality of locking members of said ratchet ring engage said plurality of said locking members of said first collar, to said disengaged position, in which said plurality of locking members of said ratchet ring are spaced from said plurality of locking members of said first collar, thereby allowing said first collar to rotate with respect to said connector body.

12. A connector coupling according to claim 11, wherein one of said first and second engagement members is a pin, and the other of said first and second engagement members is a channel.

13. A connector coupling according to claim 12, wherein said channel is a bayonet channel that has an open end and a closed end opposite said open end, said pin is received in said open end of said channel when said second collar is in said first position, and said pin is received in said closed end of said channel when said second collar is rotated to said closed end of said channel.

14. A connector coupling according to claim 11, wherein said first engagement member is a channel disposed in an outer surface of said first collar, said channel has opposite open and closed ends; and said second engagement member is a pin extending inwardly from said second collar, said pin engages said open end of said channel when said second collar is in said first position, and said pin engages said closed end of said channel when said second collar is in said second position.

15. A connector coupling according to claim 11, wherein said plurality of locking members of said first collar and said ratchet ring are interengaging teeth.

16. A connector coupling according to claim 11, further comprising an actuating ring received in said second collar, said actuating ring including at least one inward extension for abutting said plurality of locking members of said ratchet ring when said ratchet ring is in said disengaged position.

17. A connector coupling according to claim 16, wherein said plurality of locking members of said first collar extend from spaced apart projections extending inwardly from said first collar; and said at least one inward extension of said actuating ring is received in at least one slot defined between said spaced apart projections of said first collar.

18. A connector coupling, comprising of:

a connector body;

a first collar coupled to said connector body, a second collar surrounding said first collar;

engagement means for engaging said first collar and said second collar so that said second collar rotates with respect to said first collar between first and second positions;

a ratchet ring supported by said connector body, said ratchet ring being axially movable with respect to said connector body between an engaged position and a disengaged position;

locking means for locking said first collar and said ratchet ring when said ratchet ring is in said engaged position; and a biasing member supported by said connector body adjacent said ratchet ring, said biasing member biasing said ratchet ring in said engaged position, wherein rotating said second collar from said first position to said second position moves said ratchet ring from said engaged position, in which said ratchet and said first collar are locked by said locking means, to said disengaged position, in which said ratchet ring is spaced from said first collar, thereby allowing said first collar to rotate with respect to said connector body.

19. A connector coupling according to claim 18, wherein said locking means including interlocking teeth.

20. A connector coupling according to claim 18, wherein said engagement means includes a cooperating bayonet channel and pin.

21. A connector coupling according to claim 18, further comprising an actuating means coupled to said second collar for moving said ratchet ring from said engaged position to said disengaged position.

22. A connector coupling according to claim 21, wherein said actuating means is a ring that includes at least one inward extension for abutting said plurality of locking members of said ratchet ring when said ratchet ring is in said disengaged position.

* * * * *